US011015906B2

(12) United States Patent
Lulay

(10) Patent No.: US 11,015,906 B2
(45) Date of Patent: May 25, 2021

(54) AERIAL RECONNAISSANCE MARKING PROJECTILE

(71) Applicant: Sharon Lulay, Salem, OR (US)

(72) Inventor: Sharon Lulay, Salem, OR (US)

( * ) Notice: Subject to any disclaimer, the term of this patent is extended or adjusted under 35 U.S.C. 154(b) by 11 days.

(21) Appl. No.: 16/656,278

(22) Filed: Oct. 17, 2019

(65) Prior Publication Data

US 2021/0116222 A1 Apr. 22, 2021

(51) Int. Cl.
*F42B 12/40* (2006.01)
*F41B 7/00* (2006.01)

(52) U.S. Cl.
CPC ..... *F42B 12/40* (2013.01); *F41B 7/003* (2013.01)

(58) Field of Classification Search
CPC .. F42B 4/26; F42B 12/36; F42B 12/38; F42B 12/40; F42B 12/44; F42B 12/46; F42B 12/50; F41B 7/00; F41B 7/003
USPC ..... 124/27; 102/336, 342, 356, 360, 501, 102/502, 503, 513, 202, 202.5, 204, 205, 102/237, 247, 268, 275.1, 458
See application file for complete search history.

(56) References Cited

U.S. PATENT DOCUMENTS 197,339 A * 11/1877 Coston ..... F42B 4/02 102/346
1,451,395 A * 4/1923 Hustvedt ..... F42B 12/40 89/1.1
3,706,151 A * 12/1972 McNeill ..... F42B 12/40 42/106
3,744,419 A * 7/1973 Hand ..... F42B 4/22 102/360
4,448,106 A * 5/1984 Knapp ..... F42B 12/40 102/501
4,791,870 A * 12/1988 Simpson ..... C06B 39/00 102/342
4,839,985 A * 6/1989 Barry ..... A01K 81/00 43/132.1
5,235,915 A * 8/1993 Stevens ..... C06B 33/00 102/439
5,661,257 A * 8/1997 Nielson ..... F42B 12/48 102/334
6,155,174 A * 12/2000 Hervieu ..... C06B 23/00 102/395
6,257,146 B1 * 7/2001 Stonebraker ..... F42B 5/10 102/346

(Continued)

OTHER PUBLICATIONS

Hunter; Keith, "Pin on X Thing to Make", https://images.app.goo.gl/6MgDTstjWaei2hPQ6, Lakewood, Colorado, U.S.A.

(Continued)

*Primary Examiner* — Alexander R Niconovich
(74) *Attorney, Agent, or Firm* — Anthony Claiborne

(57) ABSTRACT

An aerial projectile apparatus provides a means for marking terrestrial and marine locations for identification from afar, as by aerial reconnaissance. The projectile is launched from ground level at a location where identification is desired. When the projectile is lofted to an appropriate elevation, it disperses a spray of marker substance in the form of droplets or solid particles. When the sprayed marker substance settles to ground level, it leaves a mark on the landscape or marine surface indicating the location for identification by aerial reconnaissance.

18 Claims, 5 Drawing Sheets

(56) References Cited

U.S. PATENT DOCUMENTS 6,619,211 B1 * 9/2003 Haeselich ..... F42B 8/12 102/513
7,025,001 B2 * 4/2006 Brunn ..... F42B 7/10 102/336
7,487,728 B2 * 2/2009 Cranor ..... F42B 12/40 102/513
7,793,591 B1 * 9/2010 Van Stratum ..... F42C 9/10 102/443
7,908,972 B2 * 3/2011 Brunn ..... F42B 7/02 102/458
8,065,962 B2 * 11/2011 Haeselich ..... F42B 8/14 102/513
8,256,351 B1 * 9/2012 Kramer ..... F42C 11/065 102/502
8,297,187 B2 * 10/2012 Sullivan ..... F42B 12/40 102/213
8,518,196 B2 * 8/2013 Hahma ..... F42B 4/26 149/2
8,677,904 B2 * 3/2014 Rexford ..... F42B 12/42 102/345
8,783,186 B2 * 7/2014 Scanlon ..... F42B 8/14 102/513
9,074,857 B2 * 7/2015 Cranor ..... F42B 12/40
10,107,604 B1 * 10/2018 Spaulding ..... F42B 7/08
10,845,172 B2 * 11/2020 Moreno ..... F42B 8/16
2005/0139363 A1 * 6/2005 Thomas ..... A62C 3/025 169/30
2005/0188886 A1 * 9/2005 Vasel ..... F42B 6/10 102/502
2009/0084284 A1 * 4/2009 Martinez ..... F42B 12/40 102/504
2013/0048317 A1 * 2/2013 Charlton ..... F42B 12/50 169/46
2013/0055916 A1 * 3/2013 Menefee, III ..... F42B 7/08 102/334
2013/0055917 A1 * 3/2013 Menefee, III ..... F42B 7/04 102/334
2013/0217025 A1 * 8/2013 Gibson ..... B01J 19/0046 435/6.12
2015/0020705 A1 * 1/2015 Hartmann ..... A62C 3/025 102/369
2019/0195604 A1 * 6/2019 Rodgers, Jr. ..... F42B 12/40

OTHER PUBLICATIONS

"Sigsauer Sig516 Owner's Manual", P/N 8501240-MIL-01 REV00, https://www.sigsauer.com/wp-content/uploads/2016/07/SIG516.pdf, p. 18, Sig Sauer, Inc., 72 Pease Boulevard, Newington, NH 03801 USA.

* cited by examiner

AERIAL RECONNAISSANCE MARKING PROJECTILE

BACKGROUND OF THE INVENTION

Field of the Invention

This invention is related to aerial flares. More specifically, this invention relates to aerial projectiles adaptable for identifying the location of a user, with specific application for distress signaling.

Description of the Related Art

Aerial flares are a form of projectile pyrotechnics used for distress signaling, illumination, or defensive countermeasures in civilian and military applications. Typically, aerial flares used for distress signaling are easily deployed from ground level by the use of flare guns or handheld percussive tubes. Aerial flares are generally propelled aloft either by percussive combustion at deployment or by rocket propulsion fueled by a rocket propellant with an oxidizer such as perchlorate.

In the related art, flares used for distress signaling are propelled upward to a certain elevation at which they produce a transitory visible signal. At elevation, flares used for signaling during daylight hours emit either visible smoke or particles of colored powder for signaling. Signals from daylight flares are visible for a period of time until the signaling medium is dispersed by wind currents. The signal from flares used during nighttime is a light produced through the combustion of a pyrotechnic composition in the flare when the flare reaches elevation. Signals from nighttime flares are visible until their light-producing pyrotechnic composition is depleted. In either case, the location of the visible signal from the flare enables observers to infer an approximate the location of the signaler below.

The use of related art flares for locating signalers is subject to a number of limitations. First, the flare's signal indicates the location of the flare itself, not of the signaler. Depending upon the trajectory of the flare, the actual location of the signaler may be displaced considerably from the ground level location that corresponds to the flare's signal. Second, the duration of the flare's signal is relatively short, at most a matter of minutes. If approximation of the signaler's location is not made by an observer during the period of time that the flare's signal is visible, locating the signaler may be difficult. Further, if the observer is not present at the time the flare's signal is visible, signaler location is not possible. Yet further, the transitory nature of related art flare signal limits its utility in locating the signaler by aerial reconnaissance.

What is needed is a device as easy to use as the related art flares, that provides an indication of signaler location that is more certain and of longer duration than that provided by the related art flare signal, and that better enables signaler location by aerial reconnaissance.

SUMMARY OF THE INVENTION

An aerial projectile, when launched, provides a means for marking terrestrial and marine locations enabling identification by aerial reconnaissance. Some embodiments of the projectile, launched by flare gun, hand-held percussive tube, and the like, are fashioned to be lofted in the manner of an aerial flare. In some such embodiments, the projectile is lofted by percussive charge at deployment. Other such embodiments are lofted by solid rocket propellant with an oxidizer such as perchlorate. Alternatively, some embodiments loft the projectile using spring tension imparted by a spring-powered gun.

The projectile is launched from ground level at a location where identification is desired. When the projectile is lofted to an appropriate elevation, it disperses a spray of marker substance in the form of unlit droplets or solid particles, serving as a means for terrestrial marking. The marker substance employed by the invention is such that, when it is dispersed, the unlit substance settles to ground level and leaves a mark on the landscape or marine surface indicating and identifying the location.

The marker substance may be a dye or powder that has a distinctive color enabling identification from afar in daylight or under illumination. Alternatively or in addition, the marker substance may be particularly reflective in a distinctive electromagnetic wavelength in the near infra-red or near ultra-violet, permitting identification by appropriately selected photographic film or electronic imaging. Yet further, the marker substance may have fluorescent properties, emitting a characteristic luminescence when illuminated with light of the appropriate wavelength. The marker may be selected especially for contrast with a specific terrain or maritime background.

After its release from the projectile, the marker substance settles to ground level below the projectile's trajectory. In terrestrial applications, the marker substance settles on the terrain and objects such as trees. For maritime applications, the density of the marker substance particles or droplets must be less than that of the target body of water. On the water, the marked area will be indicated by marker substance floating on the surface. In either terrestrial or maritime applications, while ultimate dispersal of the mark left by the invention is inevitable, the mark will persist much longer than the duration of a flare's signal, thereby greatly improving the likelihood of location and identification from afar.

BRIEF DESCRIPTION OF THE DRAWINGS

Objects of the present invention as well as advantages, features and characteristics, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE INVENTION

Figure 1A:
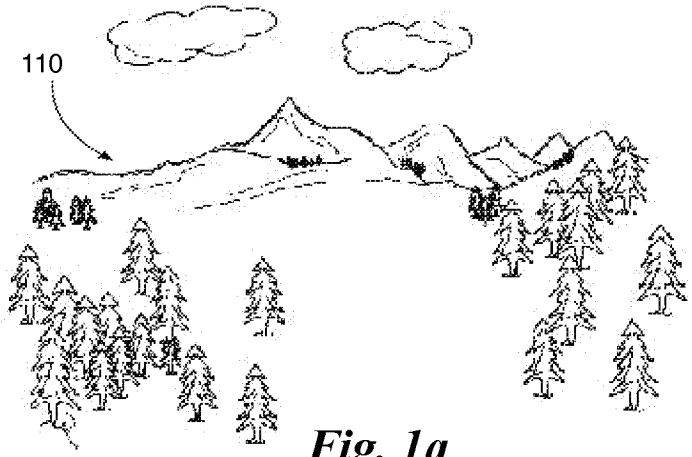
FIGS. 1*a*, 1*b*, 1*c* and 1*d* illustrate the operation of one exemplary embodiment of the invention above a terrain.
Figure 1B:
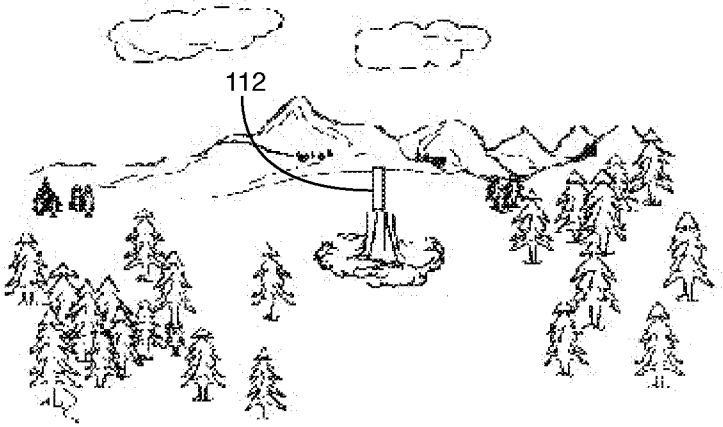
Figure 1C:
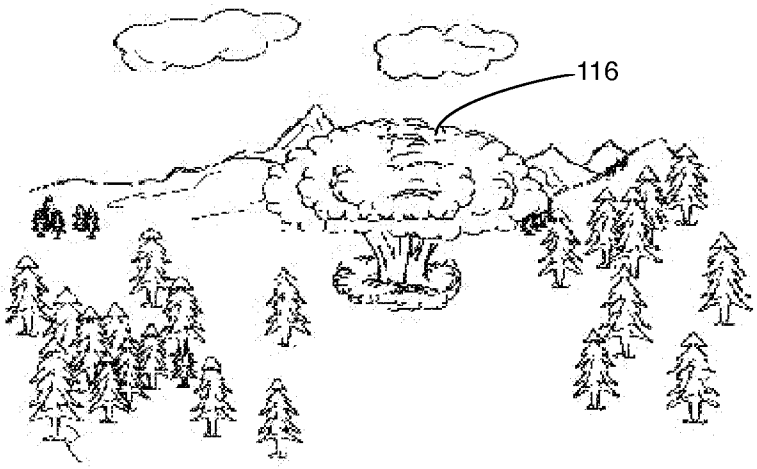
Figure 1D:
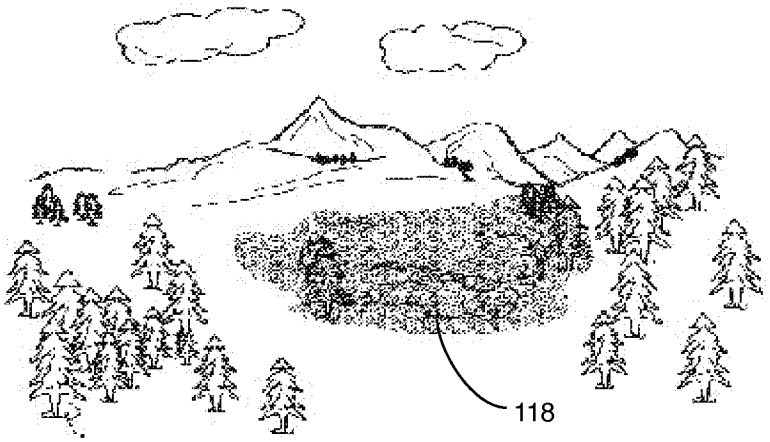

Turning now to the drawings, FIGS. 1*a*-1*d* show the sequence of events in the lofting and deployment of an embodiment of the invention above a terrestrial landscape 110 depicted in FIG. 1*a*. The projectile 112 is launched as shown in FIG. 1*b* and is lofted to a certain elevation where it disperses a marking substance 116, as shown in FIG. 1*c*, that sinks downward to ground level, leaving a roughly disc-shaped mark 118 on landscape 110 as shown in FIG. 1*d*.

Figure 2:
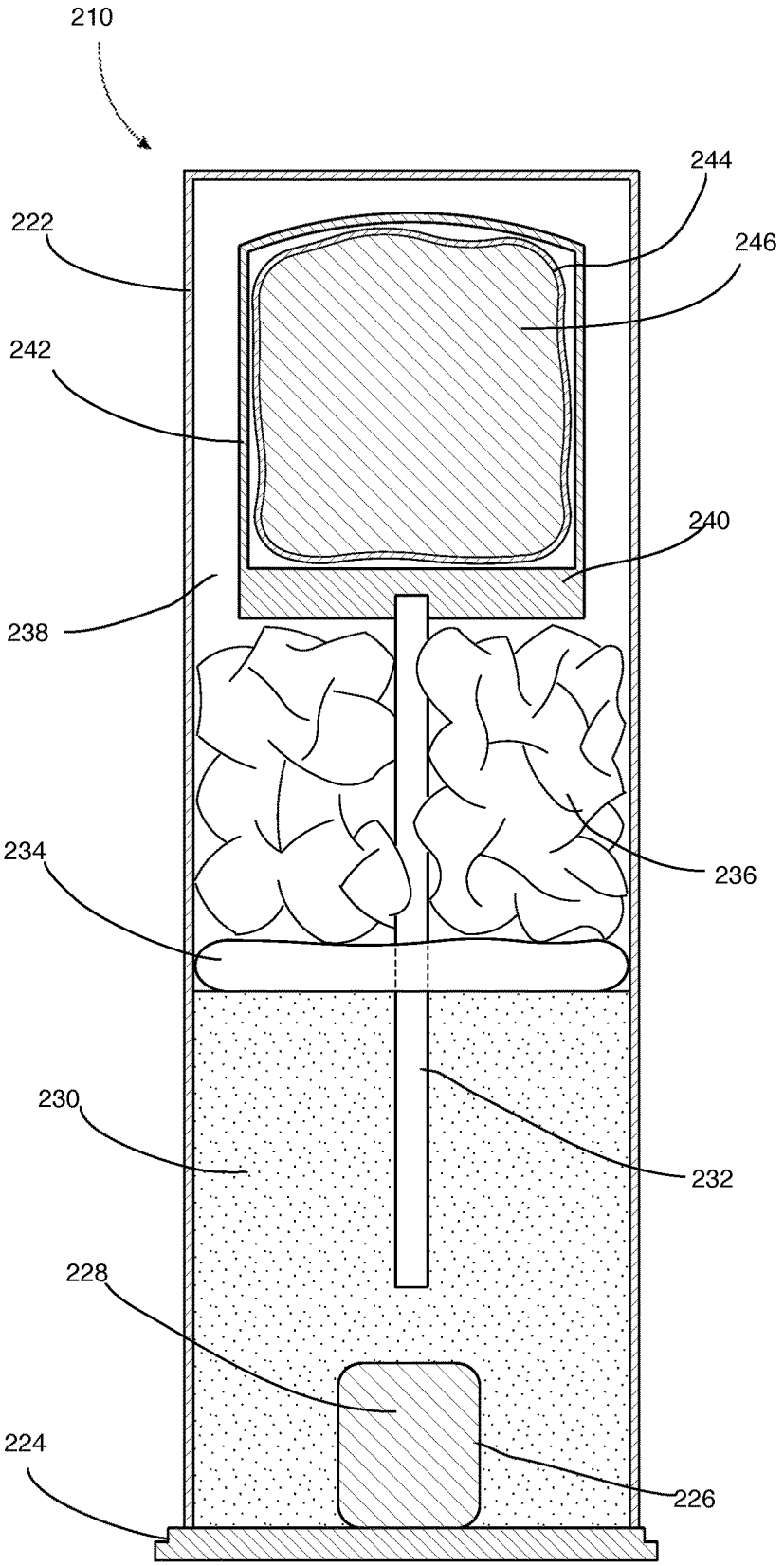
FIG. 2 shows a cross-sectional view of one embodiment of the invention, wherein the projectile is fashioned to be lofted by percussive combustion.

FIG. 2 depicts a cross-sectional view of an embodiment of the invention wherein the projectile is fashioned to be lofted by percussive combustion. Projectile 210 comprises casing 222 and base 224, dimensioned to be compatible with such commonly available flare guns as sold in the Orion Alert Plus Marine Emergency Kit manufactured by Orion Safety Products of Easton, Md. Casing 222 is typically fashioned of formed or molded plastic sheet or treated paper, while base 224 may be constructed of metal in the manner of a conventional shotgun shell. Within base 224 of projectile 210 is a primer pocket 226 with a primer 228 located therein. In exemplary embodiments, primer 228 is Federal 209A primer, well-known to those in the art of shotgun shell technology. Disposed around primer 228 is a deposit of explosive propellant 230, a quick igniting granular explosive flake such as Alliant Blue Dot®, manufactured by Alliant Powder of Lewiston, Id. Disposed within the deposit of explosive propellant 230 roughly 5 millimeters above primer 228 is fuse 232. An exemplary fuse 232 utilizes a fusing mixture comprising 70 percent strontium peroxide by weight, 25 percent magnesium metal by weight, and 5 percent strontium nitrate by weight, bound with calcium resinate, all retained within a flammable straw made of paper.

Disposed within casing 222, lying above propellant 230 is propellant cap 234, retaining the flakes of propellant 230. In exemplary embodiments, propellant cap 234 is comprised of cardboard or pressed paper. Above propellant cap 234 is protective wadding 236. In the exemplary embodiment, protective wadding 236 is wadded paper tissue treated with flame retardant such as sodium bicarbonate. In other embodiments, protective wadding 236 may be loose cellulose such as home insulation material. Fuse 232 runs up through propellant cap 234 and protective wadding 236 to terminate in ejection charge 240 in marker capsule 242 disposed within an ejection cavity 238. In embodiments such as the one depicted, ejection cavity 238 is comprised of paper or formed sheet plastic, which may be of the same material as that comprising casing 222. Ejection charge 240 is a small amount of granular explosive material disposed in the bottom of marker capsule 242. The construction of marker capsule 242 and the quantity and explosive strength of ejection charge 240 are selected so that marker capsule 242 is broken open when ejection charge 240 is ignited. Exemplary embodiments comprise an ogive shaped marker capsule 242 that is vacuum formed from 0.5 millimeter polystyrene sheet along with an ejection charge 240 comprising 0.5 grams of ffff black powder.

Within marker capsule 242 is marker substance 246, shown in this embodiment as contained within a marker container 244, which may be a thin plastic membrane such as a small latex balloon holding marker substance 246 and isolating it from ejection charge 240 prior to combustion of the explosive.

In operation, projectile 210 is inserted into a flare gun's chamber and the flare gun is typically aimed vertically. When the armed flare gun's trigger is fired, the gun's hammer strikes base 224, causing primer 228 to ignite and combust the deposit of explosive propellant 230, the explosion thereof thereby simultaneously blowing through propellant cap 234 to propel marker capsule 242 outward and also igniting fuse 232 retained within marker capsule 242. Marker capsule 242 is protected from the heat and explosive force of the combustion of the deposit of explosive propellant 230 by protective wadding 236.

As marker capsule 242 proceeds upward, as illustrated in one application in FIG. 1*b*, fuse 232 continues to burn. When fuse 232 burns into marker capsule 242, ejection charge 240 ignites and combusts, thereby exploding marker capsule 242 and dispersing its contents, marker substance 246, as illustrated in one application in FIG. 1*c*. Marker substance 246 then sinks under gravity to mark the terrain below, as illustrated in FIGS. 1*c*-1*d*.

Figure 3A:
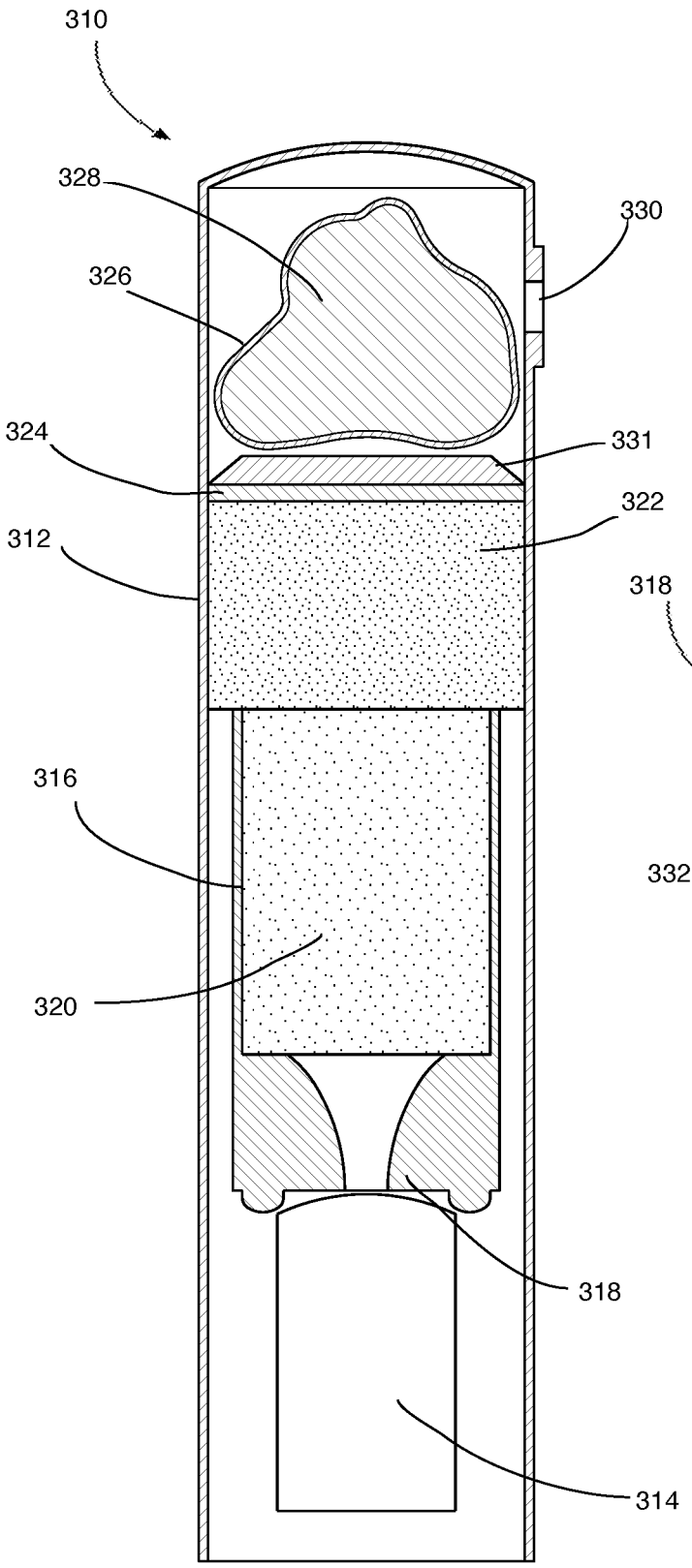
FIG. 3*a* represents a cross-sectional view of another embodiment of the invention, wherein the projectile is fashioned to be lofted by rocket propulsion.
Figure 3B:
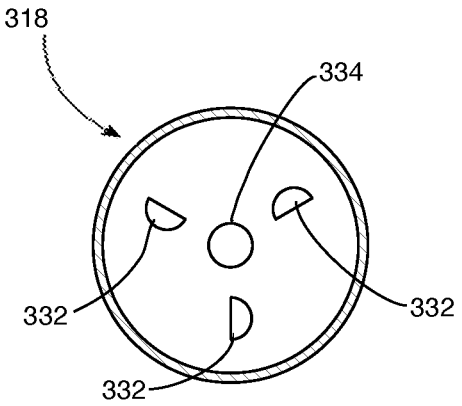
FIG. 3*b* illustrates a bottom view of the projectile illustrated in FIG. 3*a;*

Turning now to FIGS. 3*a* and 3*b*, illustrated is a projectile fashioned to be lofted by rocket propulsion according to one embodiment of the present invention. Rocket propelled projectile 310 comprises a casing 312 fashioned of aluminum. In exemplary embodiments, casing 312 is 34 millimeters in diameter and 140 millimeters in length. A plurality of slots 314 (one shown) are cut in the side of the lower portion of casing 312, the uncut portions of casing 312 surrounding such slots serving as aerodynamic fins to stabilize the trajectory of projectile 310.

Disposed within casing 312 is solid rocket motor 316, whose nozzle 318 is positioned just above slots 314. As shown in FIG. 3*b*, nozzle 318 comprises central orifice 332 and side orifices 334, the latter disposed to disperse exhaust gas from motor 316 transversely from the direction of dispersal from central orifice 332, thereby providing a means to cause projectile 310 to rotate on its main axis as it is propelled upward by thrust from central orifice 332. Nozzle 318 may be fabricated from heat resistant plastics such as Bakelite®. Alternatively, nozzle 318 may be fabricated of any material, including selected metallic and ceramic compositions, sufficiently strong and heat resistant to withstand the hot thrust produced by motor 316.

Motor 316 further comprises solid propellant 320. Embodiments of the projectile employ an aluminum perchlorate formulation for propellant 320. Besides employing ammonium perchlorate (AP) as a fuel, such formulations typically include an elastomer binder such as hydroxyl-terminated polybutadiene (HTPB), powdered metal (typically aluminum, AL), and various burn rate catalysts. Ratios by weight may vary between roughly 70/15/15 AP/HTPB/Al and roughly 80/18/2 AP/HTPB/Al, although ratios may be used outside these ranges. In some embodiments, polybutadiene acrylic acid acrylonitrile prepolymer is used to partially or completely replace HTPB.

Located atop propellant 320 is ejection charge 322, typically comprised of ffff black powder. In the exemplary embodiment, ejection charge 322 comprises 0.5 to 1.0 grams of black powder. Retaining the motor 316, propellant 320 and ejection charge 322 is integral toroidal washer 324, fixedly adhered to the interior of casing 312. Disposed above washer 324 is piston plug 331, typically a disc of stiff cardboard tightly but slidably fitting inside casing 312. Disposed above piston plug 331 is collapsible marker container 326, containing marker substance 328. In embodiments such as that depicted, marker container 326 is a balloon comprised of thin flexible material that bursts relatively easily, such as latex rubber film of 0.12 mm or less in thickness. In the side of casing 312 adjacent to marker container 326 is dispersal orifice 330, in embodiments a circular hole approximately 2.0 mm in diameter.

In operation, the depicted projectile 310 is lofted upward by ignition of the lower portion of propellant 320. Motor 316 produces upward thrust via exhaust of combustion gas through central orifice 332 and rotational thrust via exhaust of gas through side orifices 334. With trajectory stabilized by the aerodynamic effect of slots 314, projectile 310 proceeds upward while spinning rapidly until the depletion of propellant 320 causes ejection charge 322 to combust. The compression caused by the combustion of ejection charge 322 proceeds through the hole in integral toroidal washer 324 to force piston plug 331 hard against marker container 326, causing marker container 326 to burst and disperse marker substance 328 through dispersal orifice 330. The rapid spinning of projectile 310 results in dispersal of marker substance 328 in a wide disc about the projectile. The disc of marker substance 328 then sinks under gravity to mark the terrain below, as illustrated in FIGS. 1*c*-1*d*.

Figure 4:
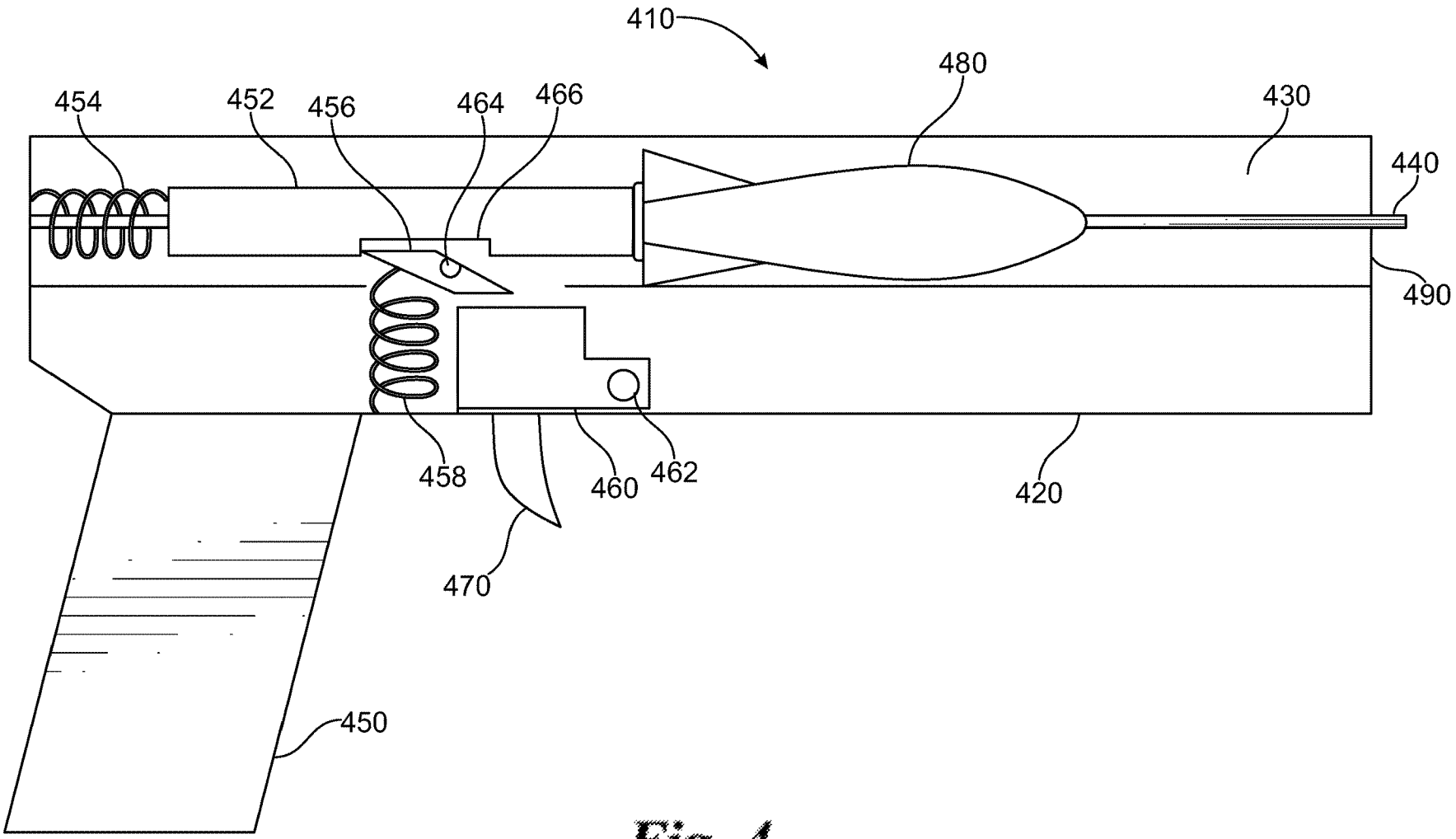
FIG. 4 illustrates a spring gun utilized by one embodiment of the invention.

FIG. 4 illustrates an exemplary spring gun used to loft an embodiment of the invention. Spring gun 410 comprises a barrel section 420 and a handle section 450. Running the length of barrel section 420 is hollow barrel 430, opening at one end in barrel opening 490. Disposed along the length of hollow barrel 430 is guide rod 440. Slidably disposed along guide rod 440 is drive piston 452, situated to slide back along guide rod 440 to compress drive spring 454. A slot 466 is cut within drive piston 452 to engage a firing catch 456 that is driven by firing spring 458, firing catch 456 configured to releasably retain drive piston 452 in compression of drive spring 454. When a user pulls trigger 470, cam 460 rotates about cam pivot 462 to cause firing catch 456 to pivot about catch pivot 464, thereby releasing piston 452 under force from compressed drive spring 454 to thrust forward and drive the projectile 480 along guide rod 440 and exit barrel opening 490 at high velocity.

Figure 5:
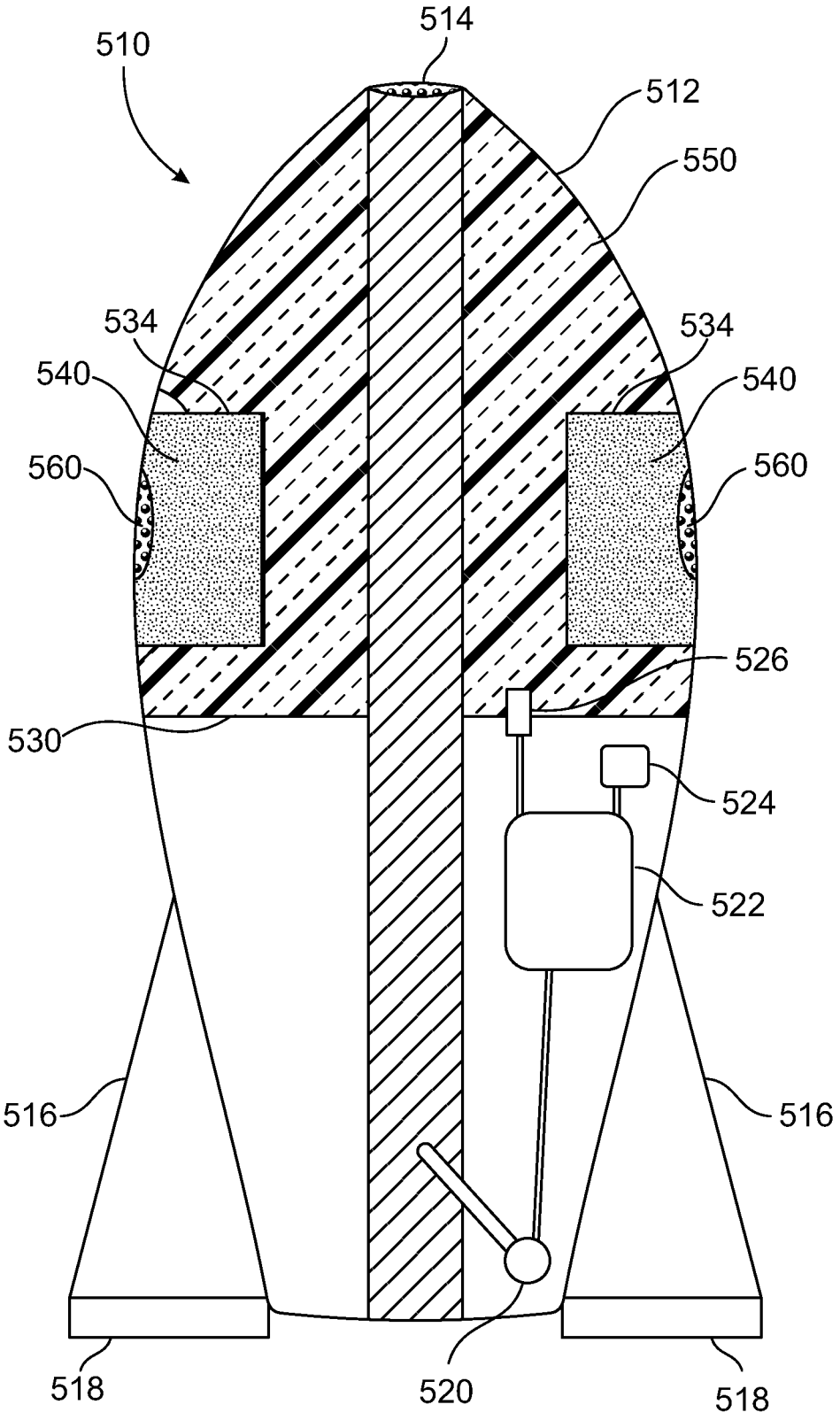
FIG. 5 shows a cross-sectional view of a spring-launched embodiment of the invention.

FIG. 5 shows a cross-section of one embodiment of the spring-driven projectile described in respect to FIG. 4. Projectile 510 comprises lacriform casing 512, which may be fabricated of thin molded polystyrene plastic. Running the length of lacriform casing 512 is rod conduit 514, fashioned to receive a guide rod in a spring gun such as that portrayed in FIG. 4. Wings 516, which may also be fabricated of polystyrene, attach to lacriform casing 512. Wings 516 comprise cantilevered flaps 518, so oriented as to provide a means to cause aerodynamic spin of projectile 510 as it is lofted. A bulkhead 530 around rod conduit 514 separates the upper portion of projectile 510 from its lower portion.

Disposed within the lower portion of projectile 510 is normally closed micro-switch 520 with lever, the lever of micro-switch 520 disposed within rod conduit 514 so that when a guide rod such as illustrated in FIG. 4 is inserted in rod conduit 514, the lever is depressed whereby normally closed micro-switch 520 is open. Micro-switch 520 is electrically connected to power-on timer circuitry 522 receiving electricity from battery 524. Timer circuitry 522 may be constructed to employ the IC555 integrated circuit timer well known to those in the electronic arts. Timer circuitry 522 is further electrically connected across bulkhead 530 to igniter element 526 disposed within the upper portion of projectile 510. Timer circuitry 522 is configured to provide voltage when activated to igniter element 526, as, for example, by appropriate use of a relay or MOSFET transistor.

Within the upper portion of projectile 510 and surrounding rod conduit 514 is toroidal marker container 534, which may be fabricated of thin sheet plastic material such as polyethylene or vinyl film. Toroidal marker container 534 contains marker substance 540, which may be a liquid solution or a substantially liquid suspension of marking material, further discussed below. Marker container 534 is pressed against orifices 560 in lacriform casing 512. Surrounding marker container 534 is explosive material 550, which may comprise black powder explosive.

In operation, a spring gun such as depicted in FIG. 4, is cocked so that its piston is engaged to compress the drive spring. Projectile 510 is placed within the spring gun with the guide rod of the spring gun projecting through rod conduit 514, thereby depressing and opening normally closed micro-switch 520. Timer circuitry 522 is configured so that the opening of normally closed micro-switch 520 causes timer circuitry to become ready. When the spring-gun is triggered and the piston of the spring gun thrusts forward under force from the drive spring of the gun, projectile 510 is launched from the barrel of the spring gun. Upon exit from the spring gun, the release of micro-switch 520 from the guide rod of the spring gun causes switch 520 to close. The closure of switch 520 activates timing in timer circuitry 522.

Projectile 510 is thus lofted upward from the spring gun. Aerodynamic forces acting on flaps 518 of wings 516 cause projectile 510 to spin rapidly along its main axis as it proceeds along its trajectory. When a set time after launch from the spring gun has elapsed, timer circuitry 522 provides voltage to igniter element 526 thereby igniting explosive material 550 to cause bursting of marker container 534 through orifices 560, whereby marker substance 540 sprays out of orifices 560. The rapid spinning of spring-gun lofted projectile 510 results in dispersal of marker substance 540 in a wide disc about the projectile. The disc of marker substance 540 then sinks under gravity to mark the terrain below, as illustrated in FIGS. 1*c*-1*d*.

Each of the depicted embodiments employs a structure timing flight duration as a means for determining when a lofted projectile will disperse marker substance. In the case of the projectile lofted by percussive combustion depicted in FIG. 2, timing is provided by the burning of a fuse initially lit by combustion of the explosive propellant. In the case of the projectile lofted by rocket motor depicted in FIG. 3*a*, timing is accomplished simply by the consumption of the motor propellant. In the case of the spring-gun launched projectile depicted in FIG. 5, an electronic timer is used to measure flight duration. These and other structures for measuring flight duration may serve as means for determining when a lofted projectile will disperse marker substance.

Other structures may be employed to determine when marker substance is to be dispersed. Embodiments include structures that measure projectile altitude above ground level, as, for example, by barometric pressure. As is well known to those in the electronic arts, relatively simple devices employing such microcontrollers as any of the Atmel 8-bit AVR controllers now manufactured by Microchip Technology, Inc. of Chandler Ariz. may be coupled with barometric sensors such at the BMP280 sensor manufactured by Bosch Sensortec GmbH of Kusterdingen, Germany to serve as reliable altimeters. Embodiments of the invention may employ such an altimeter and use it as a means for determining when a lofted projectile will disperse marker substance, in these embodiments when the projectile has reached a designated altitude above ground level.

Yet other structures may be employed to determine when the marker substance is to be released. Microcontrollers such as the AVR controllers noted above may be coupled with accelerometers such as the ADXL345 sensor manufactured by Analog Devices, Inc. of Norwood, Mass. to provide accurate measurement of device acceleration. As is well known in the art of flight dynamics, the measured instantaneous acceleration of a projectile will indicate its status in flight. Accordingly, embodiments of this invention may utilize an accelerometer such as the foregoing to determine projectile flight status based upon measurement of acceleration and thus serve as a means for determining when the projectile will disperse marker substance.

In the depicted embodiments, marker substance is dispersed pyrotechnically, by ejection charge or other explosive material, which, when ignited, serves as means to expel the marker substance outward from the projectile. Other embodiments may employ alternative means to expel the marker substance. Some embodiments of the invention may, as an alternative to pyrotechnic means, utilize a structure comprising a tank of compressed gas that, when released, serves a means to expel the marker substance from its enclosure for dispersal according to the teaching of the invention.

As noted in particular in reference to the depictions in FIGS. 2 and 3*a*, the projectile may be configured so as to rotate rapidly along its trajectory as it is lofted. Alternative embodiments of the invention may comprise an enclosure for the marker substance that may be opened at the appropriate time by an electromechanical structure, such as, for example, one based upon a servo motor under microcontroller control. In such embodiments, the centrifugal force from the spinning projectile is sufficient to cause adequate dispersal of the marker substance when the enclosure is opened. Accordingly, it is contemplated that certain embodiments of the invention use electromechanical structures as means to expel the marker substance from the projectile.

Various substances may be used for marking by the present invention. Embodiments may employ pigments that are fluorescent in daylight, such as Day-Glo® pigments produced by Day-Glo Color Corporation of Cleveland, Ohio. Because of the brightness of these pigments caused by ultraviolet radiation reflected in the visible spectrum, terrain marked by such pigments may be easily located and identified by aerial reconnaissance in daylight. Other embodiments may employ specialized pigments whose wavelength is particularly detectable by specialized photographic technology. For example, infrared reflective pigments including titanium dioxide or rutile yellow can produce marking on the target terrain that is particularly detectable in aerial reconnaissance by employing photography with specialized infrared film such as Efke IR820 film, formerly manufactured by Fotokemika d.d., of Samobor, Croatia.

Other specialized pigments reflecting highly specific wavelengths of light in the infrared, visible and ultraviolet ranges may be employed in embodiments of the present invention to be used for location by aerial reconnaissance that utilizes specialized photographic or video imaging equipment specifically configured to detect such wavelengths. In addition, in embodiments to be used for location and identification in darkness, phosphorescent pigments such as those produced by United Mineral and Chemical Corporation of Lyndhurst, N.J., may be employed in reconnaissance operations that utilize appropriately selected illumination and imaging equipment Marker substance may be simply powdered pigment of sufficiently large granule size to settle in a suitably concentrated area of terrain when dispersed by embodiments of the present invention. The required minimum granule size depends upon the density of the solid pigment material, but can range from roughly 0.5 to 1.5 millimeters or greater in diameter. Very small pigment granules are undesirable because they may drift and spread over such an area after release from the projectile that an acceptable mark is not left on the terrain.

Other embodiments may employ a suspension or solution of pigments in a liquid medium as the marker substance of the invention, to be dispersed in a spray of droplets to settle and mark the designated area. Depending upon the pigment, the target terrain and the desired persistence of the mark upon the terrain, the liquid medium may be either aqueous or oil based. In any case, marker substance droplets of 1.5 mm in diameter or greater may be required in dispersal from the projectile to avoid excess drift of the marker substance. For maritime applications, the liquid medium for the pigment of the marker substance may be water-immiscible and possess a specific gravity less than that of water, the mark of the dispersed solvated or suspended pigment thereby buoyed on the surface of the target body of water until dissipated by currents.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

I claim:

1. A projectile for marking a terrain, comprising:

a casing;

a marker substance releasably contained within the casing;

a means for lofting the projectile above a terrain;

a means for determining when the marker substance is to be released from the lofted projectile; and a means for dispersing the marker substance from the lofted projectile when it is determined that the marker substance is to be released.

2. The projectile for marking a terrain according to claim 1, wherein the means for lofting the projectile comprises a deposit of explosive propellant for percussive combustion.

3. The projectile for marking a terrain according to claim 1, wherein the means for lofting the projectile comprises a solid propellant fueled rocket motor.

4. The projectile for marking a terrain according to claim 1, wherein the means for determining when the marker substance is to be released comprises a fuse that is ignited when the projectile is lofted, the marker substance to be released when the fuse is consumed.

5. A projectile for marking a terrain according to claim 1, wherein the means for determining when the marker substance is to be released comprises a timer counting time that the projectile has been lofted.

6. The projectile for marking a terrain according to claim 1, wherein the means for determining when the marker substance is to be released comprises an altimeter measuring altitude of the lofted projectile.

7. The projectile for marking a terrain according to claim 1, wherein the means for determining when the marker substance is to be released comprises an accelerometer measuring instantaneous acceleration of the lofted projectile.

8. The projectile for marking a terrain according to claim 1, wherein the means for dispersing the marker substance from the lofted projectile comprises an ejection charge for explosively propelling the marker substance from the proj ectile.

9. The projectile for marking a terrain according to claim 1, wherein the projectile has a main axis, and further comprising a means for causing the projectile to spin rapidly on its main axis when lofted, thereby creating centrifugal force, and wherein the means for dispersing the marker substance from the lofted projectile comprises a structure configured to release the marker substance for dispersal by the centrifugal force of the spinning projectile.

10. The projectile for marking a terrain according to claim 9, wherein the structure configured to release the marker substance for dispersal is electromechanical.

11. The projectile for marking a terrain according to claim 9, wherein the structure configured to release the marker substance for dispersal is pyrotechnical.

12. The projectile for marking a terrain according to claim 1, wherein the means for dispersing the marker substance from the lofted projectile comprises a tank of releasable compressed gas for pneumatically propelling the marker substance from the projectile.

13. The projectile for marking a terrain according to claim 1, wherein the marker substance comprises fluorescent pigment.

14. The projectile for marking a terrain according to claim 1, wherein the marker substance comprises phosphorescent pigment.

15. The projectile for marking a terrain according to claim 1, wherein the marker substance comprises pigment and a liquid medium.

16. The projectile for marking a terrain according to claim 15, wherein the liquid medium is water immiscible and has a specific gravity less than that of water.

17. A projectile for lofting from a spring gun to mark a terrain, the projectile comprising, a casing;

a marker substance releasably contained within the casing;

a means for determining when the marker substance is to be released from the lofted projectile; and a means for dispersing the marker substance from the lofted projectile when it is determined that the marker substance is to be released.

18. A device for marking a terrain, comprising, a spring-gun, the spring-gun comprising:

a barrel;

a drive piston slidably disposed along the barrel;

a drive spring;

a means for retaining the drive piston under compression of the drive spring;

a means for releasing the drive piston from compression of the drive spring; and a projectile configured to be lofted by the drive piston when the drive piston is released from compression by the releasing means, the projectile comprising:

a casing;

a marker substance releasably contained within the casing;

a means for determining an elevation at which the marker substance is to be released from the lofted projectile; and a means for dispersing the marker substance from the lofted projectile when it is determined that the marker substance is to be released.

* * * * *